United States Patent [19]

Bourdet et al.

[11] Patent Number: 4,597,290

[45] Date of Patent: Jul. 1, 1986

[54] METHOD FOR DETERMINING THE CHARACTERISTICS OF A FLUID-PRODUCING UNDERGROUND FORMATION

[75] Inventors: Dominique Bourdet, Vaux-le-Pénil, France; Timothy Whittle, Salisbury, United Kingdom

[73] Assignee: Schlumberger Technology Corporation, New York, N.Y.

[21] Appl. No.: 601,838

[22] Filed: Apr. 19, 1984

[30] Foreign Application Priority Data

Apr. 22, 1983 [FR] France ..... 83 07075

[51] Int. Cl.[4] ..... E21B 47/00

[52] U.S. Cl. ..... 73/155; 166/250

[58] Field of Search ..... 73/151, 155; 364/422; 166/250

[56] References Cited

U.S. PATENT DOCUMENTS 4,328,705 5/1982 Gringarten ..... 73/155

*Primary Examiner*—Howard A. Birmiel

[57] ABSTRACT

Disclosed is a method for determining the physical characteristics of a system made up of a well and an underground formation containing a fluid and communicating with the well. A change in the rate of flow of the fluid is produced and a measurement is made of a parameter characteristic of the pressure P of the fluid at successive time intervals Δt. One then compares on the one hand, the theoretical evolution of the logarithm of the derivative $P'_D$ of the dimensionless pressure as a function of the logarithm of $t_D/C_D$, the derivative $P'_D$ being with respect to $t_D/C_D$, $t_D$ representing the dimensionless time and $C_D$ the wellbore storage (compression or decompression) effect, with on the other hand, the experimental evolution of the logarithm of the derivative ΔP' of the pressure as a function of the logarithm of the corresponding time intervals Δt, the derivative ΔP' being with respect to time t. One then determines, from the comparison of said theoretical and experimental evolutions, the product kh of the permeability k by the thickness of said formation h, and the coefficient C.

20 Claims, 5 Drawing Figures

METHOD FOR DETERMINING THE CHARACTERISTICS OF A FLUID-PRODUCING UNDERGROUND FORMATION

The present invention relates to hydrocarbon well tests making it possible to determine the physical characteristics of the system made up of a well and an underground formation (also called a reservoir) producing hydrocarbons through the well. More precisely, the invention relates to a method according to which the rate of flow of the fluid produced by the well is modified by closing or opening a valve located at the surface or in the well. The resulting pressure variations are measured and recorded in the hole as a function of the time elapsing since the beginning of the tests, i.e. since the modification of the flow. The characteristics of the well-underground formation system can be deduced from these experimental data. The experimental data of the well tests are analyzed by comparing the response of the underground formation to a change in the rate of flow of the produced fluid with the behavior of theoretical models having well-defined characteristics and subjected to the same change in the rate of flow as the investigated formation. Usually, the pressure variations as a function of time characterize the behavior of the well-formation system and the removal of fluids at a constant rate of flow, by the opening of a valve in the initially closed well, is the test condition which is applied to the formation and to the theoretical model. When their behaviors are the same, it is assumed that the investigated system and the theoretical model are identical from the quantitative as well as from the qualitative viewpoint. In other words, these reservoirs are assumed to have the same physical characteristics.

The characteristics obtained from this comparison depend on the theoretical model: the more complicated the model, the larger the number of characteristics which can be determined. The basic model is represented by a homogeneous formation with impermeable upper and lower limits and with an infinite radial extension. The flow in the formation is then radial, directed toward the well.

However, the theoretical model most currently used is more complicated. It comprises the characteristics of the basic model to which are added internal conditions such as the skin effect and the wellbore storage effect (compression or decompression of the fluid in the well). The skin effect is defined by a coefficient S which characterizes the damage or the stimulation of the part of the formation adjacent to the well. The wellbore storage effect is characterized by a coefficient C which results from the difference in the rate of flow of the fluid produced by the well between the underground formation and the wellhead when a valve located at the wellhead is either closed or opened. The coefficient C is usually expressed in barrels per psi, a barrel being equal to 0.16 $m^3$ and 1 psi to 0.069 bar.

The behavior of a theoretical model is represented conveniently by a graph of type curves which represent the downhole fluid pressure variations as a function of time. These curves are usually plotted in cartesian coordinates and in a logarithmic scale, the dimensionless pressure being plotted on the ordinate and the dimensionless time on the abscissa. Further, each curve is characterized by one or more dimensionless numbers each representing a characteristic (or a combination of characteristics) of the theoretical system made up of a well and a reservoir. A dimensionless parameter is defined by the real parameter (pressure for example) multiplied by an expression which includes certain characteristics of the well-reservoir system so as to make the dimensionless parameter independent of these characteristics.

Thus, the coefficient S characterizes only the skin effect but is independent of the other characteristics of the reservoir and the experimental conditions such as the flowrate, the viscosity of the fluid, the permeability of the formation, etc. When the theoretical model and the investigated well-formation system correspond, the experimental curve and one of the typical curves represented with the same scales of coordinates have the same shape but are shifted in relation to each other. The shifting along the two axes, the ordinate for pressure and the abscissa for time, is proportional to values of the characteristics of the well-reservoir system which can thus be determined.

Qualitative information on the underground formation, such as the presence of a fracture for example, is obtained by the identification of the different flow conditions on the graph in logarithmic scale representing the experimental data. Knowing that a particular characteristic of the well-reservoir system, such as a vertical fracture, for example, is characterized by particular flow conditions, all the different flow conditions appearing in the graph of the experimental data are identified to select the appropriate well-reservoir system model. Specialized graphs taking into account only part of the experimental data allow a more precise determination of the characteristics of the system. The graph in logarithmic scale taking into account all the data is then used to confirm the choice of the system and the quantitative determination of the characteristics of the formation. The latter are obtained by selecting a type curve having the same shape as the experimental curve and by determining the shifting of the coordinate axes of the experimental curve with respect to the theoretical curve.

Several type curve graphs correspond to the same theoretical model. This depends on the dimensionless parameters chosen for the representation of the coordinate axes of the graph, as well as on one or more indexes. An index is nothing other than an additional parameter (or a combination of parameters) chosen for the representation of the curves, in addition to the dimensionless parameters of the coordinate axes. The comparison of the different methods used is given in the article entitled "A Comparison Between Different Skin and Wellbore Storage Type Curves for Early-Time Transient Analysis" by A. C. Gringarten et al., published by the Society of Petroleum Engineers of AIME (No. SPE 8205). The U.S. Pat. No. 4,328,705 also describes a method according to which the type curves are represented using the dimensionless pressure $P_D$ or the axis of the ordinates and the ratio $t_D/C_D$ for the axis of the abscissas, $t_D$ being the dimensionless time and $C_D$ the wellbore storage coefficient of the fluid in the well. The drawback of the method described in that patent is that the type curves have shapes varying relatively slowly in relation to each other. This results in some uncertainty in the choice of the type curve corresponding to the experimental curve. It is also noted that, for a complete analysis, it is necessary to use not only a graph in logarithmic scale representing all the experimental data, but also specialized graphs in semi-logarithmic scale for example, to analyze only part of the data but in a more precise manner.

An attempt has already been made to use the mathematical derivative of the dimensionless pressure $P'_D$ instead of the dimensionless pressure $P_D$. Thus, in the article entitled "Application of the $P'_D$ Function to Interference Analysis" published in the Journal of Petroleum Technology, August 1980, Page 1465, the evolution of the deivative $P'_D$ (derivative with respect to $t_D$) as a function of $t_D$ is used for interference analysis between a production well and an observation well. Pressure variations are recorded in the observation well when the flow of the fluid produced by the producing well is modified. In this case, the skin effect and the wellbore storage effect of the fluid do not intervene. This is consequently a very simple case in which the response of the underground formation is analyzed in a well far from the producing well. The result is that there is no family of type curves but only one curve.

The derivative of the pressure $P'_D$ (derivative with respect to $t_D$) has also been used to characterize reservoirs containing two sealing faults around the reservoir in the article entitled "Detection and Location of Two Parallel Sealing Faults Around a Well" published in the Journal of Petroleum Technology, October 1980, Page 1701. That article deals only with a particular problem.

The pressure behavior of a well producing a slightly compressible fluid through a single plane of a vertical fracture in an inifinite reservoir was analyzed by means of the mathematical derivative of the dimensionless pressure $P'_D$ (derivative with respect to a dimensionless time $t_{Df}$) in the article entitled "Application of $P'_D$ Function to Vertically Fractured Wells" published by the Society of Petroleum Engineers of AIME, SPE 11028, Sept. 26–29, 1982.

That article deals only with a particular case in which the type curve is unique and for which the advantages of using the derivative of the pressure are not evident compared with conventional methods. Furthermore, the skin effect and the wellbore storage effect do not intervene.

It is the object of the present invention to provide a method for determining the characteristics of a well-reservoir system allowing a better identification between the experimental behavior of the analyzed system made up of the well and the underground formation and the behavior of a theoretical model. This is a general model, i.e. the formation can be homogeneous or heterogeneous and takes into account the skin effect and the wellbore storage effect and, if necessary, the double porosity of the reservoir and the well fractures. The method according to the present invention enables an overall and unique analysis of the behavior of the well-reservoir system without recourse to specialized analyses. The invention also permits the analysis of experimental data when the condition imposed on the system is the closing of the well, thanks to a suitable choice of parameters. The method according to the present invention can also be combined advantageously with a method of the prior art.

More precisely, the present invention concerns a method for determining the physical characteristics of a system made up of a well and an underground formation containing a fluid and communicating with said well, said formation exhibiting a skin effect and/or a wellbore storage effect (compression and decompression of the fluid in the well), and said formation being homogeneous or heterogeneous. According to the method, a change in the rate of flow of the fluid is produced and a measurement is made of a parameter characteristic of the pressure P of the fluid at successive time intervals $\Delta t$ and one compares, on the one hand, from a well-reservoir system theoretical model, the theoretical evolution of the logarithm of the derivative $P'_D$ of the dimensionless pressure as a function of the logarithm of $t_D/C_D$, said derivative $P'_D$ being with respect to $t_D/C_D$, $t_D$ representing a dimensionless time and $C_D$ the dimensionless coefficient of the wellbore storage (compression of decompression) effect of the fluid in the well, with on the other hand, the experimental evolution of the logarithm of the derivative $\Delta P'$ of the pressure as a function of the logarithm of the corresponding time intervals $\Delta t$, said derivative $\Delta P'$ being with respect to time t, and one determines, from the comparison of said theoretical and experimental evolutions, at least one characteristic of the well-formation system, chosen from among the product kh of the permeability k by the thickness of said formation h, the coefficient $C_D$ and the skin effect coefficient S.

Said theoretical evolution can advantageously be that of the logarithm of the product $P'_D \cdot t_D/C_D$ as a function of the logarithm of $t_D/C_D$ and said experimental evolution is that of the logarithm of the product $\Delta P' \cdot \Delta t$ as a function of the logarithm of $\Delta t$.

Said theoretical evolution can also be a function of an index representing a characteristic parameter of the product $C_D e^{2S}$. When the change in the rate of flow of the fluid corresponds to the closing of the well, said theoretical evolution can be compared advantageously with the experimental evolution of the logarithm of the expression:

$$\frac{t_p + \Delta t}{t_p} \cdot \Delta t \cdot \Delta P'$$

as a function of the logarithm of the time intervals $\Delta t$, $t_p$ being the time during which the well has been in production.

Certain stages of the present invention, notably the identification of the experimental data with the behaviour of a theoretical model having very precise characteristics, can be implemented by means of a computer. However, these stages are advantageously implemented by plotting a theoretical graph in cartesian coordinates and in logarithmic scale, said graph representing the theoretical evolution of the derivative $P'_D$ as a function of $t_D/C_D$ or the theoretical evolution of the product $P'_D \cdot t_D/C_D$ as a function of $t_D/C_D$.

It is also possible to plot an experimental curve by means of experimental data with the same logarithmic scale as said theoretical graph, the experimental curve representing either the experimental evolution of $\Delta P'$ as a function of $\Delta t$, or the experimental evolution of the product $\Delta P' \cdot \Delta t$ as a function of $\Delta t$. It is then possible to match the experimental curve with one of the type curves of the theoretical graph and to determine certain physical characteristics of the well-underground formation system.

It is also an object of the invention to provide theoretical graphs obtained as indicated previously.

The invention will be better understood from the following description of embodiments of the invention given as explanatory and nonlimitative examples. The description refers to the accompanying drawings in which.

Before putting a hydrocarbon well into production, measurements are generally carried out to determine the physical characteristics of the underground formation producing these hydrocarbons. This preliminary stage prior to production is very important because it makes it possible to define the most appropriate conditions for producing these hydrocarbons and for improving production. One of these measurements consists in varying the rate of flow of the produced fluid by opening or closing a valve placed in the wellhead or in the well itself, and recording the resulting pressure variations as a function of the time elapsing since the modification of the rate of flow of the produced fluid. It is possible for example to completely close the well and to record the resulting pressure build-up (an experimental build-up curve is then obtained). It is also possible to start production again in a well whose production has been stopped and to record the corresponding pressure drawdown (the experimental curve obtained is called the drawdown curve).

The pressure variations as a function of time can be followed by means of a sonde lowered into the well at the end of a cable. This may be an electric cable and, in this case, the pressure data can be transmitted directly to a recorder on the surface. When the cable is nonconducting, the pressure variations are recorded in memories placed in the sonde. These memories are then read on the surface. It is also possible to install a pressure gauge in a lateral pocket of the production tubing of the well near the producing formation. A conducting cable located in the annulus between the tubing and the casing connects the pressure gage to a recorder located on the surface. Such a device is described for example in U.S. Pat. No. 3,939,705 and 4,105,279.

The values measured by the pressure sondes generally do not correspond to the pressure itself, but to a parameter characteristic of the pressure, for example a difference of two frequencies. For convenience and clarity, the expression "pressure value" will be used hereandafter, bearing in mind that the experimental data can correspond to a parameter characteristic of the pressure.

Figure 1:
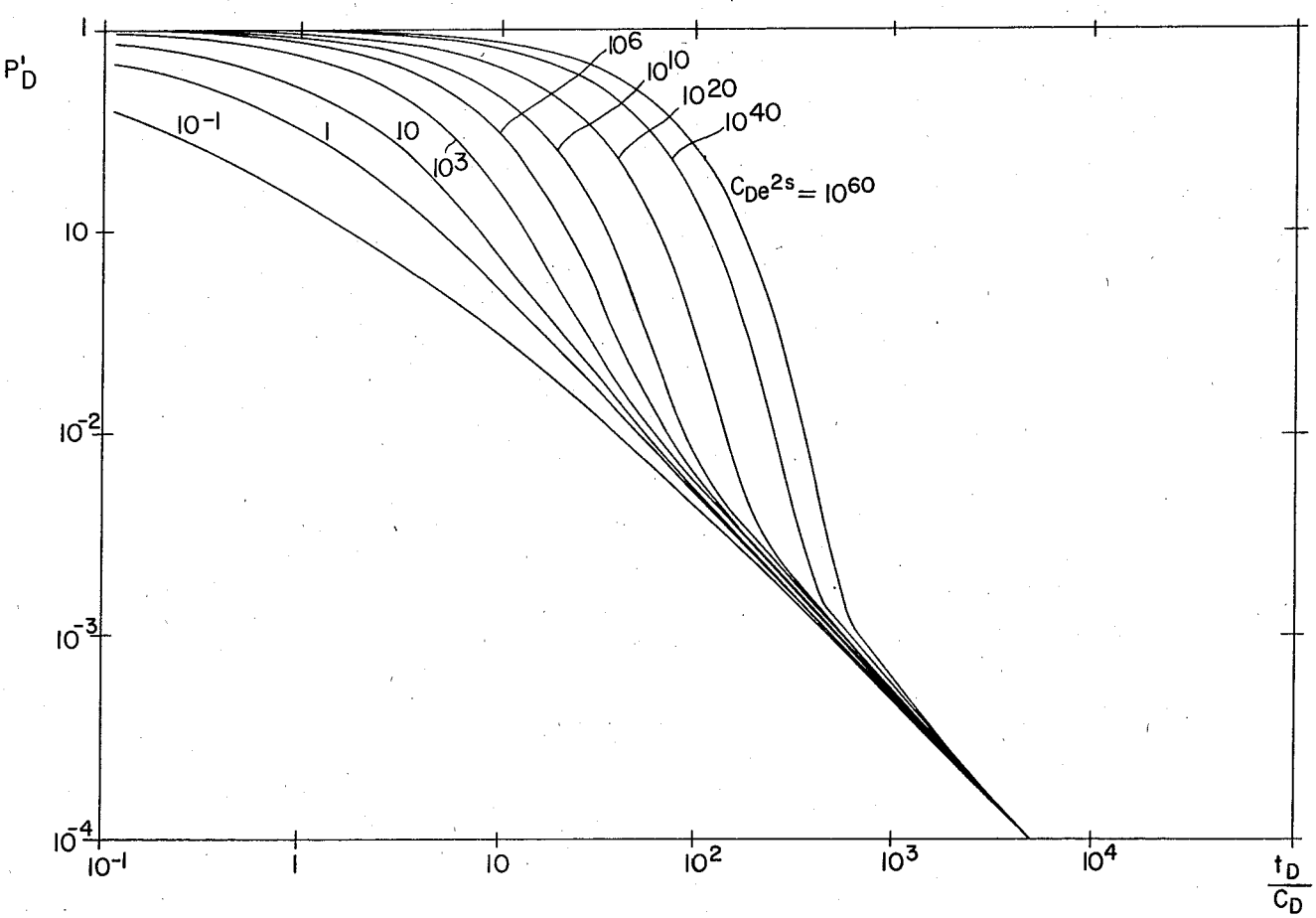
FIG. 1 represents in logarithmic scale a graph of type curves representing $P'_D$ as a function of $t_D/C_D$, the index representing the values of $C_De^{2S}$.

FIG. 1 represents a graph of new type curves in logarithmic scale representing the mathematical derivatives $P'_D$ of the dimensionless pressure $P_D$ as a function of the ratio $t_D/C_D$, $t_D$ representing the dimensionless time and $C_D$ representing the dimensionless wellbore storage coefficient of the fluid in the well. The mathematical derivative $P'_D$ is taken with respect to $t_D/C_D$. Moreover, variations in the derivative of the pressure $P'_D$ are represented with respect to an index $C_De^{2S}$, which is nothing other than a combination of two physical characteristics $C_D$ and S of the well-reservoir system analyzed. It is noted that the index $C_De^{2S}$ can take on any value, not necessarily a whole value. The value of the dimensionless pressure $P_D$ is given by the following equation, using the system of units currently used in the oil industry and called "oil field units" on Page 185 of the book entitled "Advances in Well Test Analysis" published by the Society of Petroleum Engineers of AIME", 1977:

$$P_D = \frac{kh}{141.2\, qB} \Delta P \tag{1}$$

in which:

k represents the permeability of the underground formation, h is the thickness of the formation, ΔP is the pressure variation, q is the fluid flowrate on the surface, B is the formation volume factor (expansion of the fluid between reservoir and surface) and u is the viscosity of the fluid.

The mathematical derivative $P'_D$ of the dimensionless pressure $P_D$ with respect to $t_D/C_D$ is given by the following equation:

$$P'_D = \frac{C}{0.04194\, qB} \Delta P' \tag{2}$$

in which ΔP' is the derivative (with respect to time t) of the pressure variation ΔP as a function of the time interval Δt which represents the time elapsing since the beginning of the formation test, i.e. the time interval between the instant of measurement and the instant of fluid flow modification.

The value of the ratio $t_D/C_D$ in the same system of units as for the preceding equations is given by:

$$\frac{t_D}{C_D} = 0.000295 \frac{kh}{\mu} \cdot \frac{\Delta t}{C} \tag{3}$$

in which C is the wellbore storage effect.

The graph of FIG. 1 characterizes the behavior of a homogeneous reservoir model and a well exhibiting the skin effect and the wellbore storage effect.

This graph is obtained from the equation (A.2) of the article entitled "Determination of Fissure Volume and Block Size in Fractured Reservoirs by Type Curve Analysis" published by the Society of Petroleum Engineers in September 1980, No. SPE 9293. This equation is given in the Laplace domaine. Inversion in the real-time domaine is obtained by means of an inversion algorithm, such as the one described for example by H. Stehfest in "Communications of the ACM, D-5" of Jan. 13, 1970, No. 1, Page 47.

The curves of FIG. 1 are characterized by three distinct parts: the left-hand part of the graph corresponds to the short times and is characteristic of the wellbore storage effect (this effect is greatest upon the opening the valve); the right-hand part of the graph corresponds to a pure radial flow of the reservoir; an intermediate part between the left-hand and right-hand parts corresponds to transient flow conditions between the two preceding limit flows. This intermediate flow is a function of the wellbore storage effect and the skin effet.

In the left-hand part of the graph, the curves tend toward an asymptote corresponding to a derivative equal to 1. In fact, at the very beginning of the tests, the predominant phenomenon is the wellbore storage effect, which is characterized by the equation:

$$P_D = \frac{t_D}{C_D}$$

The derivative of the dimensionless pressure with respect to $t_D/C_D$ can be written:

$$\frac{d(P_D)}{d(t_D/C_D)} = P'_D = 1 \quad (5)$$

It is seen that the derivative $P'_D$ for this type of flow is equal to 1 and that the type curves are reduced to a line with a zero curve. The right-hand part of the curve in FIG. 1, which corresponds to an infinite radial flow in a homogeneous formation, is characterized by the equation:

$$P_D = 0.5\left[\ln\frac{t_D}{C_D} + 0.80907 + \ln C_D e^{2S}\right] \quad (6)$$

ln representing the natural logarithm.

By differentiating $P_D$ with respect to $t_D/C_D$, we obtain:

$$\frac{d(P_D)}{d(t_D/C_D)} = P'_D = \frac{0.5}{t_D/C_D} \quad (7)$$

and going to the logarithmic scale:

$$\log P'_D = \log 0.5 - \log\frac{t_D}{C_D} \quad (8)$$

It is noted that the curve represented by Equation (8) is a line with a slope equal to $-1$. For the short times and long times, the curves are rectilinear and independent of $C_De^{2S}$, which is a considerable advantage compared with prior-art methods. Between the two asymptotes, for the intermediate times, each curve of index $C_De^{2S}$ has a well contrasted different shape.

Figure 2:
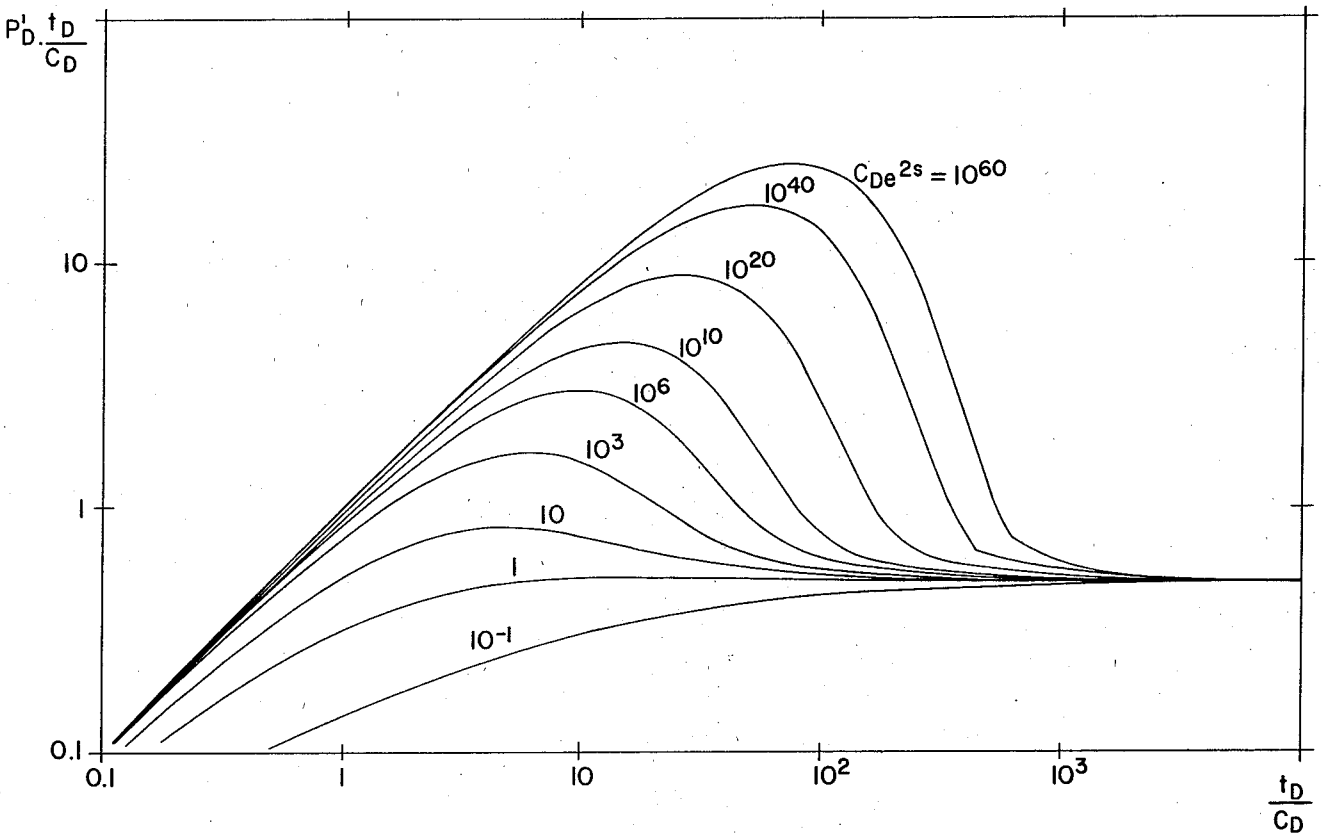
FIG. 2 shows a graph of type curves in logarithmic scale representing $P'_D \cdot t_D/C_D$ as a function of $t_D/C_D$, the index being $C_De^{2S}$.
Figure 3:
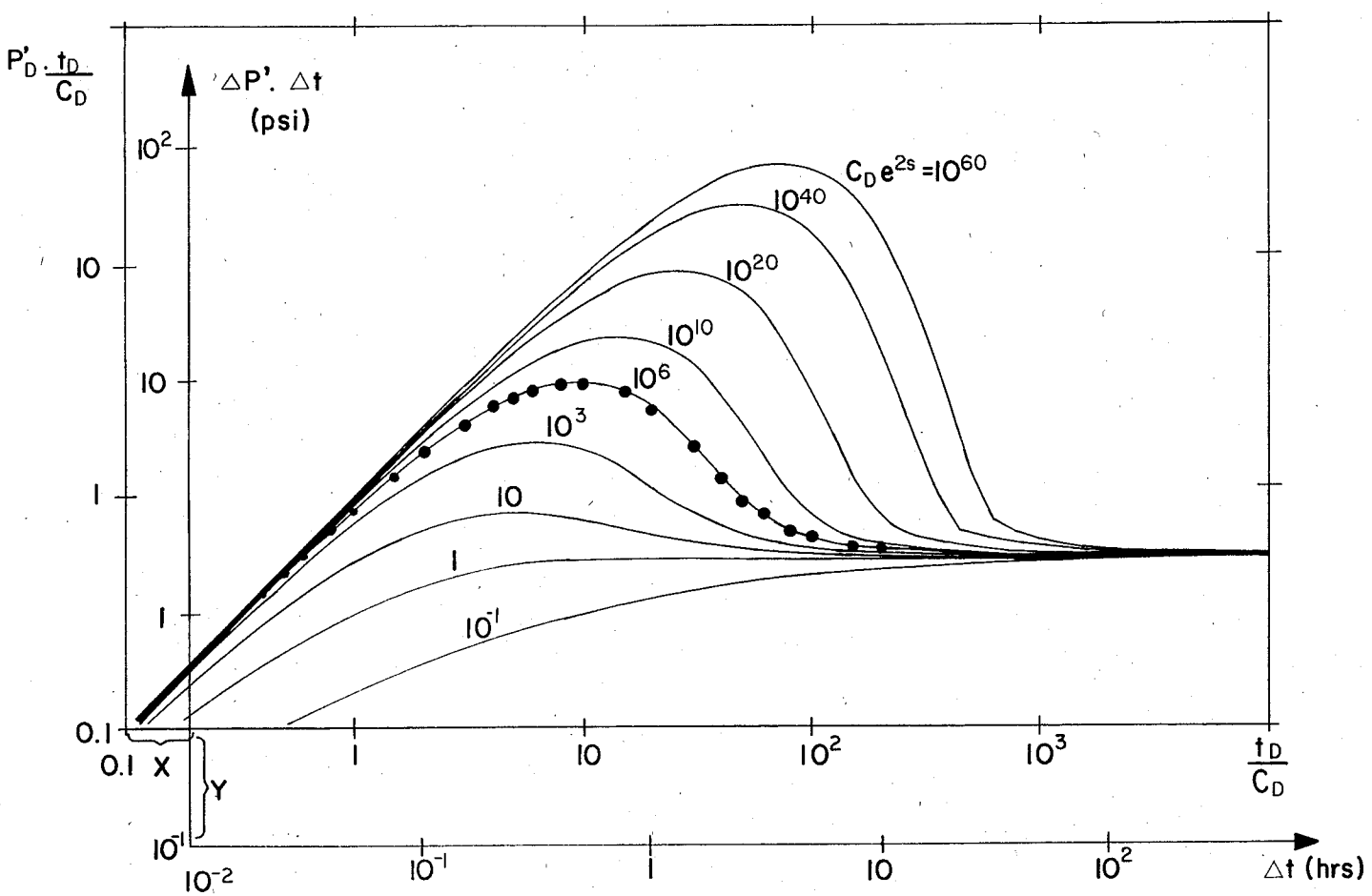
FIG. 3 illustrates the method according to the present invention for determining the physical characteristics of an underground formation producing a fluid.

If dP represents the difference of two successive measurements of the pressure of the fluid in the well and if dt represents the time interval (short) between these two successive measurements, the values $\Delta P' = dP/dt$ are calculated for all the successive pairs of measurements. This calculation makes it possible to determine in a practical manner the successive values of the mathematical derivative $\Delta P'$ which by definition is equal to the ratio dP/dt when dt tends toward zero. By plotting the curve $\Delta P'$ as a function of $\Delta t$ ($\Delta t$ being the time interval between the instant of the measurement considered and the instant of the modification of fluid flow) so as to form an experimental graph, and taking the same logarithmic scales as those used to plot the type curves of FIG. 1, it is possible to determine the physical characteristics of the well-underground formation system. In fact, the shifting of the ordinates of the experimental curve and of the type curves enables the determination of the value of C (which is evident from Equation (2) by taking log $P'_D$–log $\Delta P'$ and knowing the values of q and B). The shifting of the abscissas of the experimental curve in relation to the chosen type curve makes it possible to determine the value kh (knowing C and $\mu$, which is evident from Equation (3) by taking log $t_D/C_D$–log $\Delta t$). Finally, the choice of the type curve corresponding to the experimental curve allows the determination of the coefficient S (by the prior calculation of $C_D$ from Equation (14) as will be shown later). The theoretical graph of FIG. 1 being used in the same manner as the one in FIG. 2, by comparison with the experimental curve, only the use of the graph in FIG. 2 is illustrated (FIG. 3).

The method of determining physical characteristics by the use of the graph in FIG. 1 has been improved by following the evolution, not of the mathematical derivative of the dimensionless pressure, but by following the evolution, as a function of $t_D/C_D$, of the product of the derivative $P'_D$ of the dimensionless pressure (derivative with respect to $t_D/C_D$) with respect to the ratio $t_D/C_D$. This new method is illustrated in FIG. 2 by a graph representing the behavior of a homogeneous formation exhibiting the skin effect and the wellbore storage effect.

The axis of the ordinates corresponds to $P'_D \cdot t_D/C_D$ and the axis of the abscissas corresponds to $t_D/C_D$, $P'_D$ being the derivative of $P_D$ with respect to $t_D/C_D$.

Further, the index $C_De^{2S}$ has been chosen to represent the type curves. As in the case of FIG. 1, the predominant effect at the beginning of the well test is the wellbore storage effect. This effect corresponds to Equations (4) and (5). From Equation (5), we can write:

$$P'_D = \frac{t_D}{C_D} = \frac{t_D}{C_D} \quad (9)$$

It will be noted in this last equation that, for the short times, the type curves tend toward an asymptote with a slope equal to 1.

For the long times, corresponding to the right-hand part of the graph in FIG. 2, Equations (6) and (7) remain valid since at the end of the test there is an infinite radical flow for a homogeneous formation. Equation (7) may be written:

$$P'_D \cdot \frac{t_D}{C_D} = 0.5 \quad (10)$$

The result is that, for the long times, the value of the product $P'_D \cdot t_D/C_D$ is equal to 0.5 and the type curves tend toward an asymptote of zero slope.

it will be noted that, for the intermediate flow conditions located at the center of the graph in FIG. 2, the type curves are highly contrasted in shape, thus allowing much more precise identification of the experimental curve with one of the type curves than possible by prior-art methods. In relation to the graph of FIG. 1, it is possible to say that the graph in FIG. 2 corresponds, as a first approximation, to a rotation of 45° of the graph in FIG. 1. However, the type curves have a more accentuated relief and the presentation of the graph in FIG. 2 is more practical. The values of the index $C_De^{2S}$ are indicated on the type curves. FIG. 3 illustrates the use of the graph of the type curves of FIG. 2. This graph has been reproduced in FIG. 3 with $P'_D \cdot t_D/C_D$ on the ordinate and $t_D/C_D$ on the abscissa. The pressure differences dP measured in the well for different successive time differences dt are used to calculate the values $\Delta P' = dP/dt$ as indicated previously. The successive values of $\Delta P'$ are multiplied by the corresponding time intervals $\Delta t$ and an experimental graph is then plotted representing the product $\Delta P' \cdot \Delta t$ on the ordinate as a function of $\Delta t$ on the abscissa. The values of $\Delta P$ are in psi (1 psi=0.068 bar) and the values of $\Delta t$ are in hours. The theoretical and experimental graphs have the same logarithmic scale. One begins by superposing the right-hand part, which is rectilinear, of the experimental curve plotted in FIG. 3 by means of points, on the rectilinear part of the type curves on the right in the graph. This is easy to accomplish since this part of the curves is a straight line with a zero slope. The experimental graph is then shifted along the axis of the times so as to match its left-hand part with the right-hand part of the type curves. This is also easy since this part of the type curves is a line with a slope equal to 1. If the underground formation studied has a homogeneous behavior, the experimental curve should be superposed perfectly, to within measurement accuracy errors, on a type curve. In the example shown in FIG. 3, this type curve corresponds to $C_D e^{2S} = 10^{10}$. The shifting of the axes of coordinates of the experimental curve with the axes of the type curves makes it possible to determine the values of the product kh and the value of the wellbore storage effect. In fact, by combining Equations (2) and (3), we obtain:

$$P'_D \cdot \frac{t_D}{C_D} = \frac{kh}{141.2\, qB\mu} \Delta P' \cdot \Delta t \tag{11}$$

which is written:

$$\log\left(P'_D \cdot \frac{t_D}{C_D}\right) - \log(\Delta P' \cdot \Delta t) = \log \frac{kh}{141.2\, qB\mu} \tag{12}$$

The left-hand member of the latter equation corresponds to the shifting of the ordinates represented by Y in FIG. 3.

The value of Y makes it possible to determine the product kh. In fact, the value of the fluid flowrate q is generally known through measurements previously carried out with a flowmeter or a separator, and the values of the formation volume factor B of the fluid and its viscosity $\mu$ are determined by the analysis of fluid samples (analysis customarily referred to as "PVT"). Consequently, the value of the product of the permeability and the thickness (kh) can be determined by knowing the value Y measured.

Similarly, Equation (3) can be written:

$$\log \frac{t_D}{C_D} - \log \Delta t = \log 0.000295 \frac{kh}{\mu C} \tag{13}$$

The left-hand member of this equation corresponds to the shift X of the abscissas of the type curve chosen and the experimental curve. Knowing the value of this shift X as well as the values of the viscosity $\mu$ and of the product kh, one deduces from Equation (13) the value of the wellbore storage coefficient C.

The value of the skin effect coefficient S is determined by matching the experimental curve with one of the type curves, the matching of the two curves leading to the value of $C_D e^{2S}$. The value of $C_D$ is determined by the value of C through the following equation:

$$C_D = \frac{0.8926\, C}{\phi\, C_t h\, r^2} \tag{14}$$

in which $\phi c_t h$ represents the product of the porosity, compressibility and thickness, known from geological studies (such as the analysis of samples or electric logs) and r is the radius of the well. The value of the coefficient S can thus be calculated from the value of $C_D e^{2S}$.

The type curves shown in FIGS. 1 and 2 correspond to the behavior of a theoretical model of a homogeneous formation when the fluid flow produced by the formation is suddenly increased and, particularly, when a valve is opened on the surface of the well to produce a constant flow whereas it was closed previously (drawdown curve).

According to one of the characteristics of the present invention, for the analysis of well tests corresponding to the closing of the well, the experimental curve is plotted in logarithmic scale with the time intervals $\Delta t$ on the abscissa and with:

$$\frac{t_p + \Delta t}{t_p} \Delta t \cdot \Delta P' \tag{15}$$

on the ordinate, $t_p$ representing the time during which the formation has been in production. The analysis or the well tests can then be carried out by comparing this experimental curve with the type curves of the graph in FIG. 2.

Figure 4:
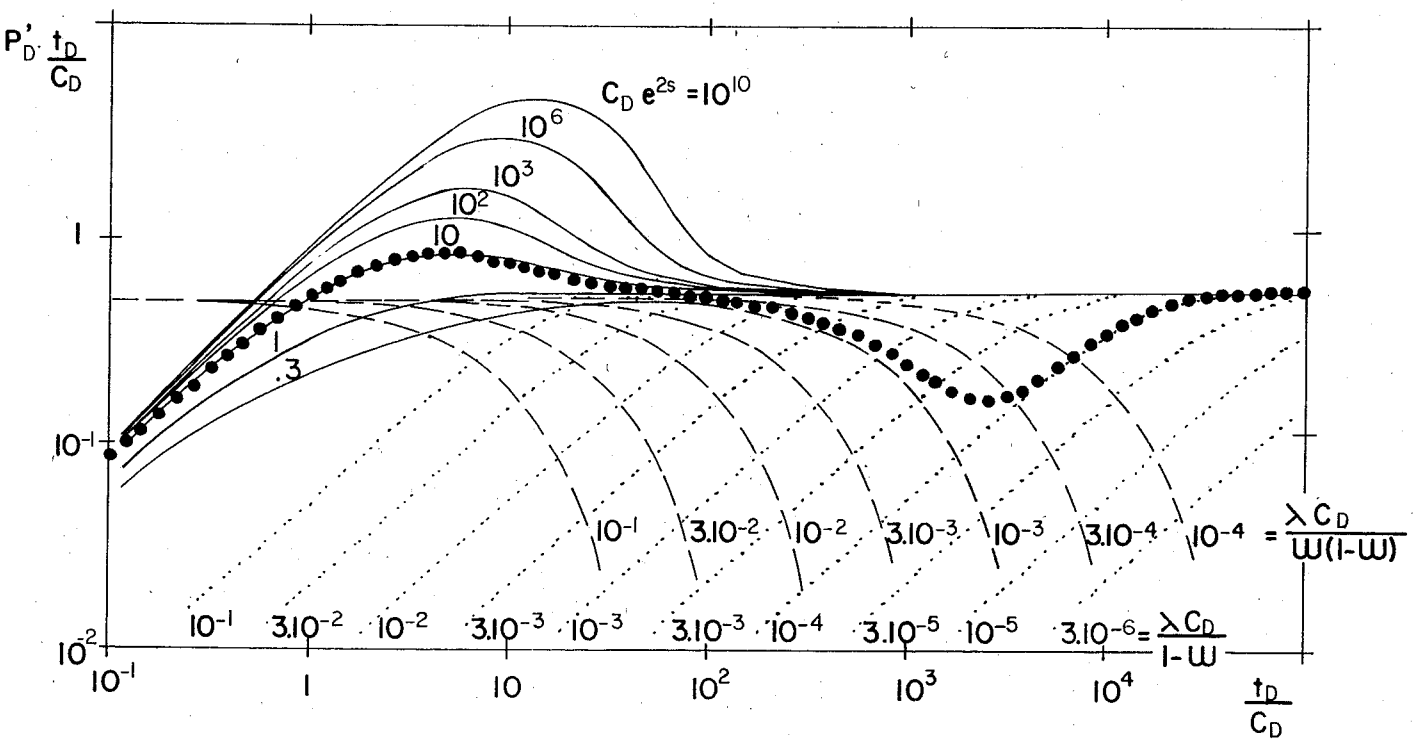
FIG. 4 represents in logarithmic scale a graph of type curves representing $P'_D \cdot t_D/C_D$ as a function of $t_D/C_D$ for a double-porosity underground formation.

The representation of the type curves, with $P'_D \cdot t_D / C_D$ on the ordinate and $t_D/C_D$ on the abscissa, is utilizable not only for homogeneous underground formations but also for nonhomogeneous formations exhibiting, for example, a double porosity. FIG. 4 shows an example of an application to a formation having a double porosity. In this case, the fluid produced by the formation is contained in the matrix, i.e. in the rock composing the formation, and in the interstices or fissures contained in the matrix. We thus have a system in which the fluid contained in the matrix first flows into the fissures before going into the well. The coefficient $\omega$ characterizes the ratio of the volume of fluid produced by the fissures to the volume of fluid produced by the total system (matrix+fissure). The coefficient $\lambda$ characterizes the delay of the matrix in producing the fluid in the fissures in relation to the production of the fissures themselves. The graph in FIG. 4 corresponds to a theoretical model of a formation having a double porosity. In this graph has been represented in solid lines the type curves corresponding to the homogeneous model, identical to those of FIG. 2, in dotted lines the type curves choosing as an index $$\frac{\lambda C_D}{1 - \omega}$$

and in semi-dotted lines the type curves choosing as an index $$\frac{\lambda C_D}{\omega(1 - \omega)}$$

The curves in dotted lines represent the equation:

$$\frac{t_D}{C_D} \cdot P'_D = \frac{1}{2}\left[1 - \exp\left(\frac{\lambda C_D}{1-\omega} \cdot \frac{t_D}{C_D}\right)\right] \quad (16)$$

The curves in semi-dotted lines represent the equation:

$$\frac{t_D}{C_D} \cdot P'_D = \frac{1}{2}\exp\left(-\frac{\lambda C_D}{\omega(1-\omega)} \cdot \frac{t_D}{C_D}\right) \quad (17)$$

Also represented by dots is a typical experimental curve characterizing a formation with a double porosity. The use of the graph in FIG. 4 makes it possible to determine the values of the coefficients $\omega$ and $\lambda$, in addition to the values of kh, C and S. It is noted that the curves characterizing the behavior of a heterogeneous model have a very marked shape when the method according to the invention is applied.

Figure 5:
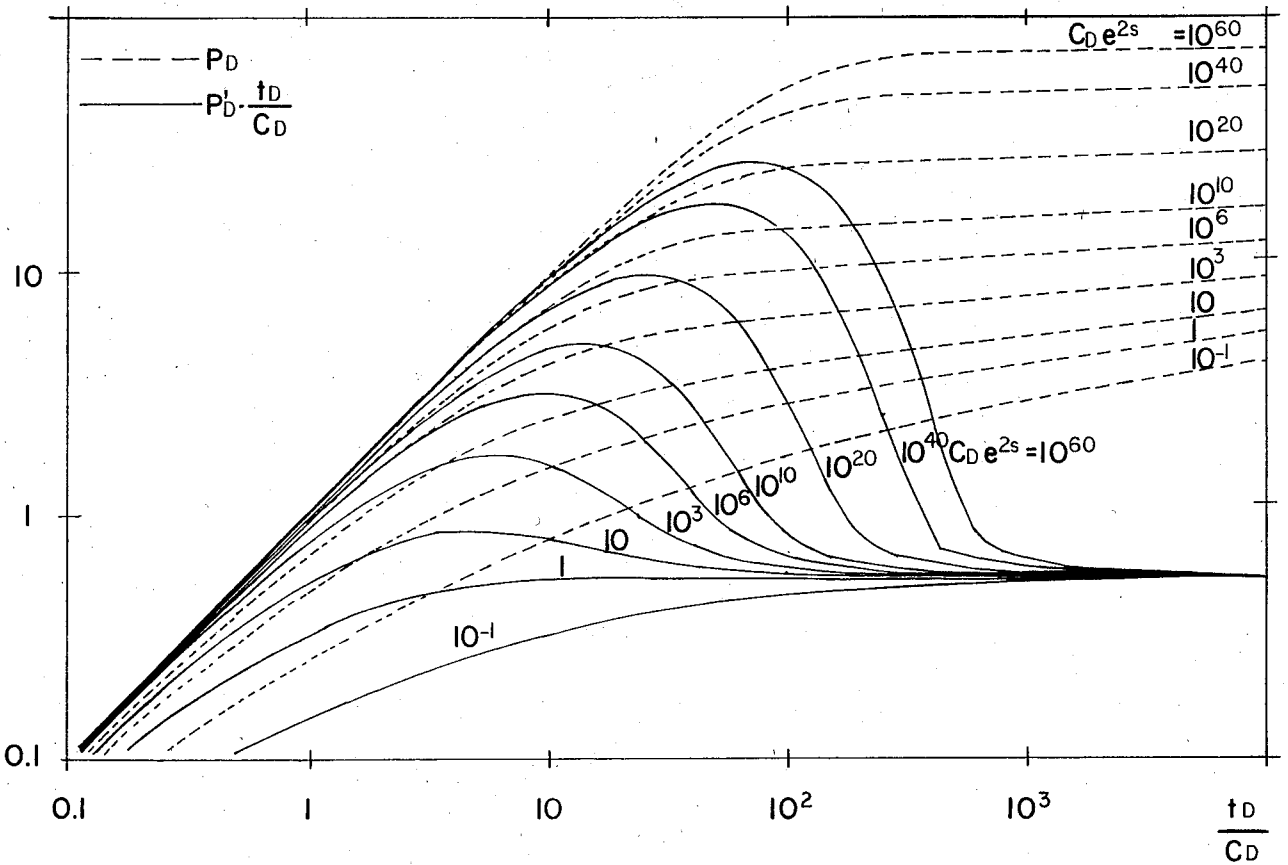
FIG. 5 represents two series of typical curves in logarithmic scale, one showing the prior-art type curves and the other showing the type curves according to the present invention.

The present invention also makes it possible to plot on the same theoretical graph the type curves of FIG. 2, $P'_D \cdot t_D/C_D$ as a function of $t_D/C_D$ but also the type curves $P_D$ as a function of $t_D/C_D$ described in the U.S. Pat. No. 4,328,705. The juxtaposition of these two series of type curves on the same graph is shown in FIG. 5. It is in fact possible to accomplish this superposition on the same graph because, to go from $P'_D \cdot t_D/C_D$ to the experimental data which are $\Delta P' \cdot \Delta t$, it is necessary to multiply the latter by a coefficient which is given by Equation (11). To go from $P_D$ to the experimental data $\Delta P$, in the case of the type curves of the above-mentioned patent, it is necessary to multiply the latter by the same coefficient as previously. It is thus possible to superpose the two series of type curves and to plot on the ordinate, with the same scale, $P_D$ and $P'_D \cdot t_D/C_D$. To use the theoretical graph of FIG. 5, one then uses the same experimental graph having two curves representing on the ordinate the variations in pressure $\Delta P$ in one case and $\Delta P'_D \cdot t_D/C_D$ in the other, $\Delta t$ being plotted on the abscissa for the two curves. The combined graph of FIG. 5 allows a more precise comparison of the two experimental curves with the type curves.

The method just described for determining the characteristics of an underground formation offers many advantages. Thus, well test analysis can be carried out by means of a single graph, whereas prior-art methods use a general graph in logarithmic scale using all the experimental data and a specialized graph in semilogarithmic scale taking into account only part of the experimental data. Owing to the behavior of the formation-well system models at the beginning and end of a well test (short times and long times on the graphs) which result in straight lines of well-defined slopes for the two ends of the type curves, the correlation of the experimental curve with the type curves can be accomplished without ambiguity. The combination of prior-art type curves with the type curves of the present invention in the same graph offers a certain advantage. In addition, the definition of a new time, given by Equation (15), makes it possible to analyze the well tests carried out with the well being closed.

It goes without saying that the present invention is not limited to the illustrative embodiments described here. Thus, the evolution of the pressure values or of the derivative of the measured pressure values can be compared with the theoretical evolution calculated on the basis of a theoretical reservoir model by means of data processing facilities such as a computer.

We claim:

1. A method for determining a physical characteristic of a system made up of at least a portion of a homogeneous or heterogeneous fluid producing underground formation traversed by a wellbore and exhibiting a skin effect and/or a wellbore storage effect, comprising:

changing the rate of flow of the fluid produced;

measuring a parameter characteristic of the pressure P of the fluid at successive times t; from said measurements, evolving the logarithm of the derivative $\Delta P'$ with respect to time t of the pressure P as a function of the logarithm of the corresponding time intervals $\Delta t$;

comparing said function evolved from said measurements with an evolution theoretically of the logarithm of the derivative $P'_D$ with respect to the ratio $t_D/C_D$ of the dimensionless pressure $P_D$ as a function of the logarithm of $t_D/C_D$, represents the dimensionless time and $C_D$ represents the dimensionless coefficient of the wellbore storage effect of fluid in the well;

and determining from said comparision, at least one of the following characteristics of the system: the product kh of the permeability k multiplied by the thickness h of the formation, the skin effect coefficient S, the wellbore storage coefficient C, the ratios $\omega$ of the fluid volume produced by the system, and the delay $\lambda$ in fluid production by the rock of the formation compared with the production of fluid by the fissures of the formation.

2. A method according to claim 1, wherein said function evolved from said measurements comprises the logarithm of the product of $\Delta P'$ multiplied by $\Delta t$ as a function of the logarithm of $\Delta t$; and wherein said function evolved theoretically comprises the logarithm of the product of $P'_D$ multiplied by the ratio $t_D/C_D$ as a function of the logarithm of $t_D/C_D$.

3. A method according to claim 1 or 2, wherein said function evolved from said measurements is also a function of a parameter characteristic of the product $C_D e^{2S}$; and wherein the skin effect coefficient S is determined.

4. A method according to claim 2, further comprising the step of plotting a graph of theoretical type curves in cartesian coordinates and in logarithmic scales, said type curves representing said theoretical evolution of the product $P' \cdot t_D/C_D$ as a function of $t_D/C_D$.

5. A method according to claim 4, wherein said plotting step further comprises superposing a second theoretical evolution of $P_D$ as a function of $t_D/C_D$ to said first theoretical graph.

6. A method according to claim 5, and further comprising the step of plotting a measurement data curve representing the evolution from said measurements of P as a function of t, and wherein the comparison step comprises matching said measurement data curve with one of the type curves of the said second theoretical graph; and wherein at least one of the characteristics kh, C and S is determined by the shifting of the ordinate axes of the second theoretical graph and of the second measurement data curve and by the choice of one of the type curves.

7. A method according to claim 4, further comprising the step of plotting two families of type curves corresponding to the indexes $$\frac{\lambda C_D}{1-\omega} \text{ and } \frac{\lambda C_D}{\omega(1-\omega)}$$

8. A method according to claim 7, further comprising the step of plotting a measurement data curve in cartesian coordinates and with the same logarithmic scale as said theoretical graph, said measurement data curve representing said evolution of the product $\Delta P' \cdot \Delta t$, as a function of $\Delta t$, and wherein said comparison step comprises matching said measurement data curve with one of the type curves of said theoretical graph; and wherein at least one of the characteristics kh, C, S, $\lambda$ and $\omega$ is determined by the shifting of the coordinate axes of the theoretical graph and of the measurement data graph and by the choice of one of the type curves.

9. A method according to claim 8, wherein the coefficient kh is determined by the shifting of the ordinate axes of the measurement data curve and of the theoretical graphs, C is determined by the shifting of the abscisssa axes of the measurement data curve, and S is determined by the choice of the type curve of the theoretical graphs that correspond to the measurement data curve.

10. A method according to claim 1, wherein the formation has a double porosity, wherein said function evolved theoretically is also a function of the indexes $$\frac{\lambda C_D}{1-\omega} \text{ and } \frac{\lambda C_D}{\omega(1-\omega)}$$

in which $\lambda$ characterizes the delay in fluid production by the rock of the underground formation compared with the production of fluid by the fissures of the underground formation, $\omega$ represents the ratio of the fluid volume produced by said fissures to the volume of fluid produced by the total system;

and wherein the values of $\lambda$ and $\omega$ are determined from the comparison of the function evolved from said measurements and the function evolved theoretically.

11. A method according to claim 10, further comprising the step of plotting two families of type curves corresponding to the indexes $$\frac{\lambda C_D}{1-\omega} \text{ and } \frac{\lambda C_D}{\omega(1-\omega)}$$

12. A method according to claim 1, wherein when said change in the rate of flow of the fluid corresponds to the closing of the well, said function evolved from said measurements is compared with the evolution theoretically of the logarithm of the expression:

$$\frac{t_p + \Delta t}{t_p} \cdot \Delta t \cdot \Delta P'$$

as a function of the logarithm of the time intervals t, $t_p$ being the time during which the well has been in production.

13. A method according to claim 1, further comprising the step of plotting theoretical type curves in cartesian coordinates and in logarithmic scales, said type curves representing said theoretical evolution of the derivative $P'_D$ as a function of $t_D/C_D$.

14. A method according to claim 13, further comprising the step of plotting a theoretical graph representing the theoretical evolution of the demensionless pressure $P_D$ as a function of $t_D/C_D$ in superposition to said plotted theoretical type curves.

15. A method according to claim 13, further comprising the step of plotting a measurement data curve in cartesian coordinates and with the same logarithmic scale as said theoretical curves, said measurement data curve representing said evolution from said measurements of $\Delta P'$ as a function of $\Delta t$, and wherein said comparison step comprises matching said measurement data curve with one of said theoretical type curves and wherein said at least one of the characteristics kh, C, S, $\lambda$ and $\omega$ is determined by the shifting of the axes of coordinates of the theoretical curves and of the measurement data curve and by the choice of type curve.

16. A method according to claim 15, wherein the wellbore coefficient C is determined by the shifting of the ordinate axes of the measurement data curve and of the theoretical curves, kh is determined by the shifting of the abscissa axes of the measurement data curves and the theoretical curve, and S, $\omega$ and $\lambda$ are determined by the choice of the type curve of the theoretical curves corresponding to the measurement data curve.

17. A method for determining a physical characteristic of a system made up of at least a portion of a homogeneous or heterogeneous fluid producing underground formation traversed by a wellbore and exhibiting a skin effect and/or a wellbore storage effect, based on data obtained by changing the rate of flow of the fluid produced and measuring a parameter characteristic of the pressure P of the fluid at successive times t, comprising:

from said measurement data, evolving the logarithm of the derivative $\Delta P'$ with respect to time t of the pressure P as a function of the logarithm of the corresponding time intervals $\Delta t$;

comparing said function evolved from said measurement data with an evolution theoretically of the logarithm of the derivative $P'_D$ with respect to the ratio $t_D/C_D$ of the dimensionless pressure $P_D$ as a function of the logarithm of $t_D/C_D$, wherein $t_D$ represents the dimensionless time and $C_D$ represents the dimensionless coefficient of the wellbore storage effect of fluid in the well;

and determining from said comparison, at least one of the following characteristics of the system: the product kh of the permeability k multiplied by the thickness h of the formation, the skin effect coefficient S, the wellbore storage coefficient C, the ratio $\omega$ of the fluid volume produced by the system, and the delay $\lambda$ in fluid production by the rock of the formation compared with the production of fluid by the fissures of the formation.

18. A method according to claim 17, wherein said function evolved from said measurement data comprises the logarithm of the product of $\Delta P'$ multplied by $\Delta t$ as a function of the logarithm of $\Delta t$; and wherein said function evolved theoretically comprises the logarithm of the product of $P'_D$ multiplied by the ratio $t_D/C_D$ as a function of the logarithm of $t_D/C_D$.

19. A method according to claim 18, further comprising the steps of from said measurement data, evolving the logarithm of P as a function of the logarithm of the corresponding time intervals $\Delta t$;

and comparing said logarithm of $\Delta P$ as a function of the logarithm of $\Delta t$ with an evolution theoretically of the logarithm of the dimensionless pressure $P_D$ as a function of the logarithm of $t_D/C_D$, wherein $t_D$ represents the dimensionless time and $C_D$ represents the dimensionless coefficient of the wellbore storage effect of fluid in the well.

20. A method according to claim 18, further comrising the steps of:

from said measurements, evolving the logarithm of $\Delta P$ as a function of the logarithm of the corresponding time intervals $\Delta t$;

and comparing said logarithm of $\Delta P$ as a function of the logarithum of $\Delta t$ with an evolution theoretically of the logarithm of the dimensionless pressure $P_D$ as a function of the logarithm of $t_D/C_D$, represents the dimensionless time and $C_D$ represents the dimensionless coefficient of the wellbore storage effect of fluid in the well.

* * * * *